United States Patent [19]

Atkins

[11] 4,042,970

[45] Aug. 16, 1977

[54] DUAL FREQUENCY NARROW-BAND FREQUENCY MODULATED KEYABLE CONTROL CIRCUIT AND KEYING CIRCUIT THEREFOR

[75] Inventor: Carl E. Atkins, Montclair, N.J.

[73] Assignee: Wagner Electric Corporation, Parsippany, N.J.

[21] Appl. No.: 657,760

[22] Filed: Feb. 13, 1976

[51] Int. Cl.[2] ..... E05B 49/00

[52] U.S. Cl. ..... 361/172; 340/147 F; 340/171 PF; 340/258 C; 343/6.5 LC; 361/182; 361/203

[58] Field of Search ..... 317/134, 146; 307/10 AT; 343/6.5 LC, 6.5 SS; 340/147 MD, 147 F, 171 R, 171 PF, 274 C, 258 C, 280

[56] References Cited

U.S. PATENT DOCUMENTS

| | | | |
|---|---|---|---|
| 3,182,315 | 5/1965 | Sweeney | 343/6.5 SS |
| 3,671,721 | 6/1972 | Hunn et al. | 340/258 C X |
| 3,732,465 | 5/1973 | Palmer | 317/134 |
| 3,891,980 | 6/1975 | Lewis et al. | 317/134 X |
| 3,970,824 | 7/1976 | Walton et al. | 343/6.5 LC X |

*Primary Examiner*—Harry E. Moose, Jr.
*Attorney, Agent, or Firm*—Eyre, Mann, Lucus & Just

[57] ABSTRACT

A keyable control circuit generates a narrow-band FM signal. A keying circuit, containing two tuned circuits, placed next to the tank coil of the keyable control circuit, absorbs rf energy each time the FM signal sweeps past the resonant frequency of one of the tuned circuits. Detector circuits within the keyable control circuit, upon sensing the amplitude modulation imposed by the cyclic absorption by one of the tuned circuits, cause the rf frequency of the FM signal to jump to a second frequency region. If the second tuned circuit in the keying circuit matches the new frequency, detector circuits again detect the amplitude modulation imposed by the cyclic absorption. After detecting the second signal, the keyable control circuit generates an electrical control signal output for use by external circuits.

9 Claims, 7 Drawing Figures

DUAL FREQUENCY NARROW-BAND FREQUENCY MODULATED KEYABLE CONTROL CIRCUIT AND KEYING CIRCUIT THEREFOR

BACKGROUND OF THE INVENTION

A number of patents disclose single-channel keyable control circuits. For example circuits disclosed in U.S. Pat. Nos. 3,624,415 and 3,628,099, both in the names of Carl E. Atkins and Arthur F. Cake, show keying circuits which require that the correct value of resistance in an external keying circuit be connected to actuate a keyable control circuit. In U.S. Pat. No. 3,723,967 in the names of Carl E. Atkins and Paul A. Carlson, a single channel inductively coupled tuned keying circuit absorbs energy from the radio frequency tank circuit of a free-running oscillator operating at the frequency to which the keying circuit is tuned. Radio frequency detection circuits detect the reduction in energy remaining in the oscillator and thereupon produce a control signal.

In U.S. Pat. No. 3,842,324 an external keying circuit includes a diode having a sharply variable junction capacitance with changes in diode bias as a component in a tuned circuit. When coupled to a keyable control circuit operating in the correct frequency range, absorbed rf energy causes rapid cyclic fluctuations in diode bias. The resulting rapid fluctuations in keying circuit resonant frequency alternately bring the keying circuit into and out of resonance with the rf frequency being generated. When in resonance, the keying circuit absorbs more rf energy from the rf oscillator than when out of resonance. The resulting amplitude in the rf oscillator is detected to provide a control output signal.

SUMMARY OF THE INVENTION

A keyable control circuit couples a first radio frequency to a sensing coil. The sensing coil is in a position which is accessible to an external keying circuit. The first radio frequency is frequency modulated about its mean frequency. The keying circuit contains a first tuned circuit tuned to a fixed frequency within the frequency range of the frequency modulated first frequency. Each time the radio frequency is swept past the frequency to which the first tuned circuit is tuned, the tuned circuit absorbs more energy from the keyable control circuit than when the frequency is remote from that to which the first tuned circuit is tuned. Thus during the frequency modulation sweep the energy absorbed exhibits cyclic variations. The amplitude of the radio frequency in the keyable control circuit exhibits corresponding cyclic variations at twice the FM sweep frequency due to the cyclic absorption by the first tuned circuit.

A detector, responding only to amplitude modulation of the radio frequency, generates a first detection signal which causes the radio frequency oscillator to jump to a second radio frequency. The second radio frequency is similarly frequency modulated. If a second tuned circuit in the keying circuit is tuned within the frequency range of the frequency modulated second frequency, amplitude modulation of the radio frequency in the keyable control circuit is again generated in the same way as previously described.

Detection of the first frequency initiates a timing cycle. If the second frequency is detected before the end of the timing cycle, a control output signal is generated. The control output signal can be used to lock or unlock a door, or initiate or terminate any other action which can be controlled by an electrical signal. If the system fails to detect the second frequency before the end of the timing cycle, the radio frequency oscillator jumps back to its first frequency and no control output signal is generated. The short time provided for detection at the second frequency makes tampering more difficult.

It is evident that a third, fourth and additional frequencies could be required in sequence before the control signal is produced.

BRIEF DESCRIPTION OF THE DRAWINGS

The detailed description of the preferred embodiment is best understood by reading with reference to the drawings of which.

FIGS. *2a* through *2e* show curves illustrating the functions of portions of the system.

DETAILED DESCRIPTION OF THE PREFERRED EMBODIMENT

Figure 1:
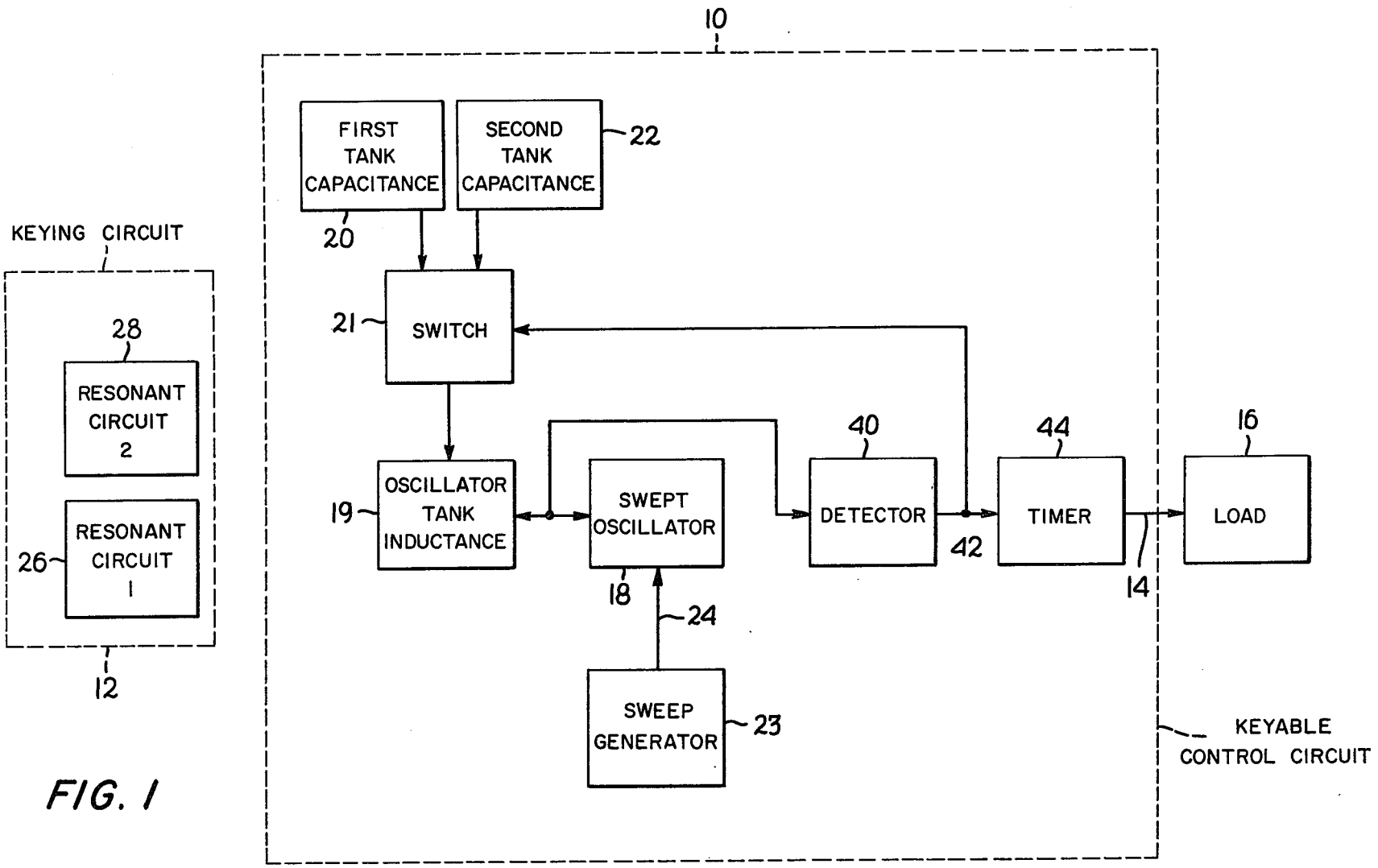
FIG. 1 shows a block diagram of the system.

A block diagram of the preferred embodiment of the invention is shown in FIG. 1. A keyable control circuit, shown generally at 10, is shown disposed in the vicinity of a keying circuit 12. When actuated by the proximity of a correctly tuned keying circuit 12, the keyable control circuit 10 provides a control output 14 to a load 16. A swept oscillator 18 in the keyable control circuit 10 generates a radio frequency at a frequency determined by an oscillator tank inductance 19 and a first tank capacitance 20. The first tank capacitance 20 is connected to the oscillator tank inductance 19 by a switch 21. A second tank capacitance 22 is initially disconnected by the switch 21. A sweep generator 23 connects a cyclically varying sweep voltage signal 24 to the swept oscillator 18. The sweep voltage signal 24 can have any shape such as sinusoidal, triangular or sawtooth. Application of the sweep voltage signal to the swept oscillator 18 causes the frequency of the radio frequency to vary in step with the sweep voltage signal 24 about the mean rf frequency determined by the oscillator tank inductance 19 and first capacitance 20. The frequency range of deviation, over which the radio frequency is swept is very narrow as will be explained in later paragraphs.

The keying circuit 12, preferably installed in a single portable container, contains a first and second sharply tuned resonant circuit 26, 28. The first and second resonant circuits 26, 28 are tuned to different frequencies. The difference between the resonant frequencies of the tuned circuits 26, 28 is much greater than the FM deviation of the radio frequency.

Figure 2C:
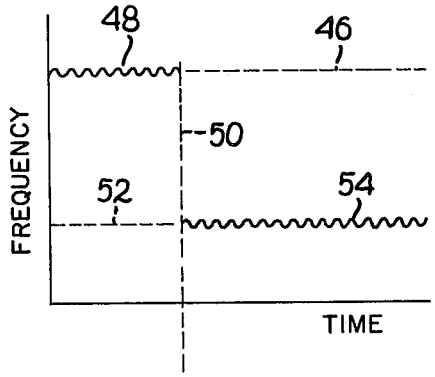
Figure 2A:
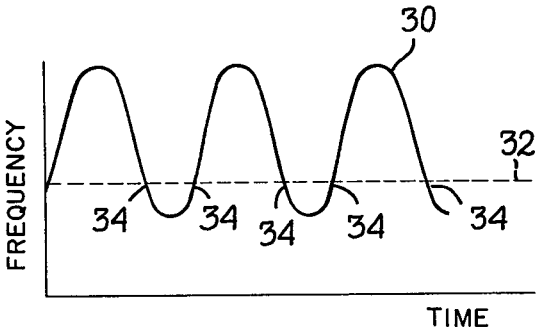
Figure 2D:
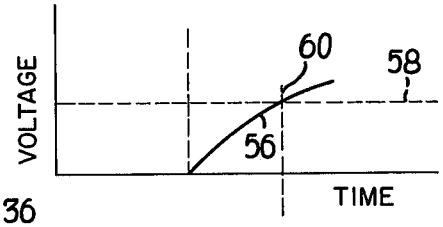
Figure 2B:
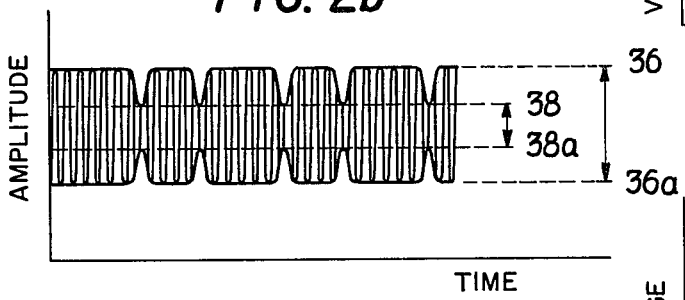
Figure 2E:
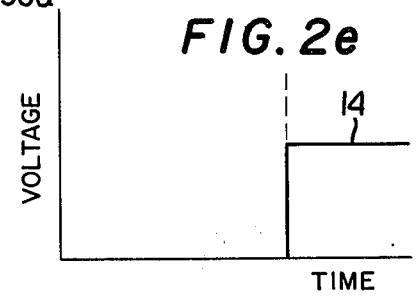

When the keying circuit 12 is brought into proximity with the keyable control circuit 10 in such a way that both resonant circuits 26, 28 are inductively coupled to the oscillator tank inductance 19, if the resonant frequency of either resonant circuit 26, 28 is in the sweep range of the swept oscillator, the respective resonant circuit 26, or 28, absorbs more radio frequency when the swept frequency is at its resonant point than when it is further away. This principle is illustrated in the curves FIGS. *2a* and *2b.* In FIG. *2a,* the sinusoidal deviation in the radio frequency 30 is shown. The center frequency of first resonant circuit 26, for example, is shown as a horizontal dashed line 32 on FIG. *2a.* Each time the radio frequency 30 is swept past the center frequency of the first resonant circuit 26, indicated at intersection points 34, energy is absorbed by the first resonant circuit 26. The envelope of the radio frequency energy remaining in the oscillator tank is momentarily diminished at these intersection points 34. The amplitude of the radio frequency in the swept oscillator 18 during this cyclic absorption is shown in FIG. 2*b*. Note that the normal peak-to-peak amplitude of the radio frequency 36, 36*a* is diminished to 38, 38*a* at the intersection times 34. Returning now to FIG. 1, in a manner to be described later, a detector 40 senses the alternating ampltiude component in the radio frequency envelope and generates a detector output signal 42 which both initiates a timing cycle in timer 44 and also feeds back a switching signal to the switch 21. The timer 44 prevents an output 14 being generated until the end of its timing cycle. The detector output signal 42, fed back to the switch 21, disconnects the first tank capacitance 20 and connects the second tank capacitance 22 to the oscillator tank inductance 19. The substitution of capacitances causes an immediate shift in the radio frequency. The frequency shift is great enough that the first resonant circuit, previously within the FM sweep range of the swept oscillator 18, is no longer within the FM sweep range. This principle is illustrated in FIG. 2*c*. The center of the first frequency is indicated by the horizontal dashed line 46. The narrowband swept oscillator frequency around the first frequency is shown as small wiggles 48 about the first frequency 46. When switching takes place, at a time indicated by the vertical dashed line 50, the center frequency of the signal jumps to a much lower (or higher) second frequency indicated by the horizontal dashed line at 52. The swept radio frequency continues after the switching time as indicated by the wiggles 54 about the second frequency 52. Note particularly that the frequency deviation of the signal is small compared to the separation between first and second frequencies. As an example, and not intended as a limitation, a deviation of 600 hertz could be applied with a frequency difference between the two signals of 10 kilohertz. A single tuned circuit cannot be within the FM sweep range of both frequencies.

Returning again to FIG. 1, detector 40 allows the detector output signal 42 to persist for a short time after the detection at the first frequency. This persistence enables switch 21 to maintain the second frequency for long enough to enable circuit stabilization and detection at the second frequency. Detection at the second frequency requires that the resonant frequency of the second resonant circuit 28 in the keying circuit 12 be within the sweep range of the second frequency. The timing cycle of timer 44 is considerably longer than the persistence time of detector output signal 42. Thus the timer 44 blocks any output until well past the persistance of the detector output signal 42. Thus if the second resonant circuit 28 fails to match the second frequency, a detectable signal is not generated within the persistence time. If the persistence time ends before detection at the second frequency, the detector output signal 42 is terminated and the timer 44 blocks any output 14. On the other hand, if the second frequency succeeds in generating a detectable signal within the persistence time, the detector output continues for as long as the keying circuit 12 continues to interact with the keyable control circuit 10. At the end of the timing cycle of timer 44, the timer 44 connects an enable signal 14 to the load 16 and continues to provide this signal for as long as it continues to receive the detector output signal 42.

The following detailed circuit description refers to the schematic diagram FIG. 3 wherein the circuit functions described in connection with FIG. 1 are boxed and identically numbered. The swept oscillator 18 is made up of amplifiers A1 and A2 with associated components. Capacitor C5 provides a path for positive feedback from the output of amplifier A2 to the input of amplifier A1 through input capacitor C4. Although any oscillator frequency may be used by varying the circuit values, a frequency in the vicinity of 2 mhz, established by the given components, has been found to be convenient. The output of amplifier A2, fed back through capacitor C5, is also connected to the tank circuit initially comprised of oscillator tank inductance L1 and capacitance C2. The connection of capacitance C2 in parallel with tank inductance L1 is made through the normally closed contacts K1A of deenergized relay K1. The oscillator frequency is swept by a sweep voltage signal 24, provided by a sweep oscillator 23 (see FIG. 1) of a type well known in the art, connected through resistor R1 to the junction of capacitance C1 and varactor diode D1. As an example of a useable sweep voltage 24, a sweep voltage of 0.5 volts peak-to-peak at a frequency of 4khz yields a deviation of 600 hertz.

Since capacitor C1 and varactor diode D1 are connected in parallel with the tank inductance L1, the net capacitance of this combination contributes to determining the oscillator frequency. As the sweep voltage signal 24 varies the voltage across varactor diode D1, the junction capacitance of varactor diode D1 varies in step. Thus the net capacitance across the tank inductance L1 and the oscillator frequency are swept in step with the sweep voltage signal 24.

When the keying circuit 12 is brought into proximity with the keyable control circuit 10 such that inductive coupling exists between the tank inductance L1 and the inductance L3 in the first resonant circuit 26, cyclic resonant absorption occurs in the first resonant circuit 26 made up of inductance L3 and capacitance C9 in the manner previously described.

Diode D2 in the detector 40, detects the audio frequency component in the modulated radio frequency caused by the cyclic absorption. The audio frequency component is amplified, and any radio frequency components in the signal are rejected in ac-coupled amplifiers A3 and A4 and their related components. The ac component of the detected audio signal is connected through capacitor C14 to the peak detector comprised of diodes D3 and D4 and capacitor C15. The peak detector diodes D3, D4 maintain capacitor C15 charged to approximately the peak of the positive swing of the detected and amplified signal. DC-coupled amplifiers A5, A6 and Q1 drive a darlington relay driver amplifier comprised of transistors Q2 and Q3. A detected signal causes transistor Q3 to turn on. Transistor Q3 thereby provides an energization signal to the coil of relay K1. Relay contacts K1A and K1B are switched to their energized positions. Contacts K1A disconnect capacitor C2 from the tank circuit and substitute capacitor C3 in its place. This causes the oscillator 18 to switch to the second frequency. Closed relay contacts K1B begins feeding voltage through limiting resistor R13 to timing capacitor C16. When the voltage across timing capacitor C16 exceeds the reference voltage at the junction of the voltage divider formed by resistors R11 and R12, the output of timer comparator A7 switches from low to high. This timer output signal 14 is connected to the load 16.

FIGS. *2c, 2d* and *2e* having aligned time bases show how the timer operates. At the instant the contacts of relay K1 close, indicated by the vertical dashed line at 50, the means frequency shifts from the first frequency 46 to the second frequency 52. At the same time, contacts K1B begins feeding charging current to timing capacitor C16. FIG. *2d* shows the voltage across the timing capacitor C16 beginning to increase at the switching time 50 and charging toward the supply voltage. If the timing capacitor voltage 56 is allowed to increase until it equals the reference voltage 58 at the time indicated by the dashed vertical line 60, the control output signal 14, shown in FIG. *2e* changes from low to high.

Returning now to FIG. 3, after detection at the first frequency, peak-detector capacitor C15 continues to provide a positive voltage through succeeding amplifiers to the coil of relay K1 for a short sustaining time after switching takes place. The sustaining time is determined by the time constant of peak-detector capacitor C15 in combination with parallel bleeder resistor R7. A time constant of 100 milliseconds has been found to give sufficient time to attain detection at the second frequency if a circuit properly tuned to the second frequency is presented. If the second frequency is detected within the sustaining time, the charge in peak-detector capacitor C15 is replenished by the new detected signals before becoming exhausted. Thus, the energization voltage to the coil of relay K1 is maintained for as long as the second resonant circuit 28 remains inductively coupled to the tank circuit inductance L1.

If the second frequency is not detected before the end of the sustaining time, relay K1 is deenergized. Contacts K1B disconnect the charging voltage to timing capacitor C16 and substitute a connection to ground. Diode D6 provides a rapid discharge path to ground for the charge stored in timing capacitor C16 through the small value of resistor R14. Thus, when the first frequency is again detected, after failure to detect the second freqency, the timer is forced to go through a complete recharging sequence. This prevents a build-up of charges in a sequence of detections of the first frequency when the second frequency is absent.

Figure 3:
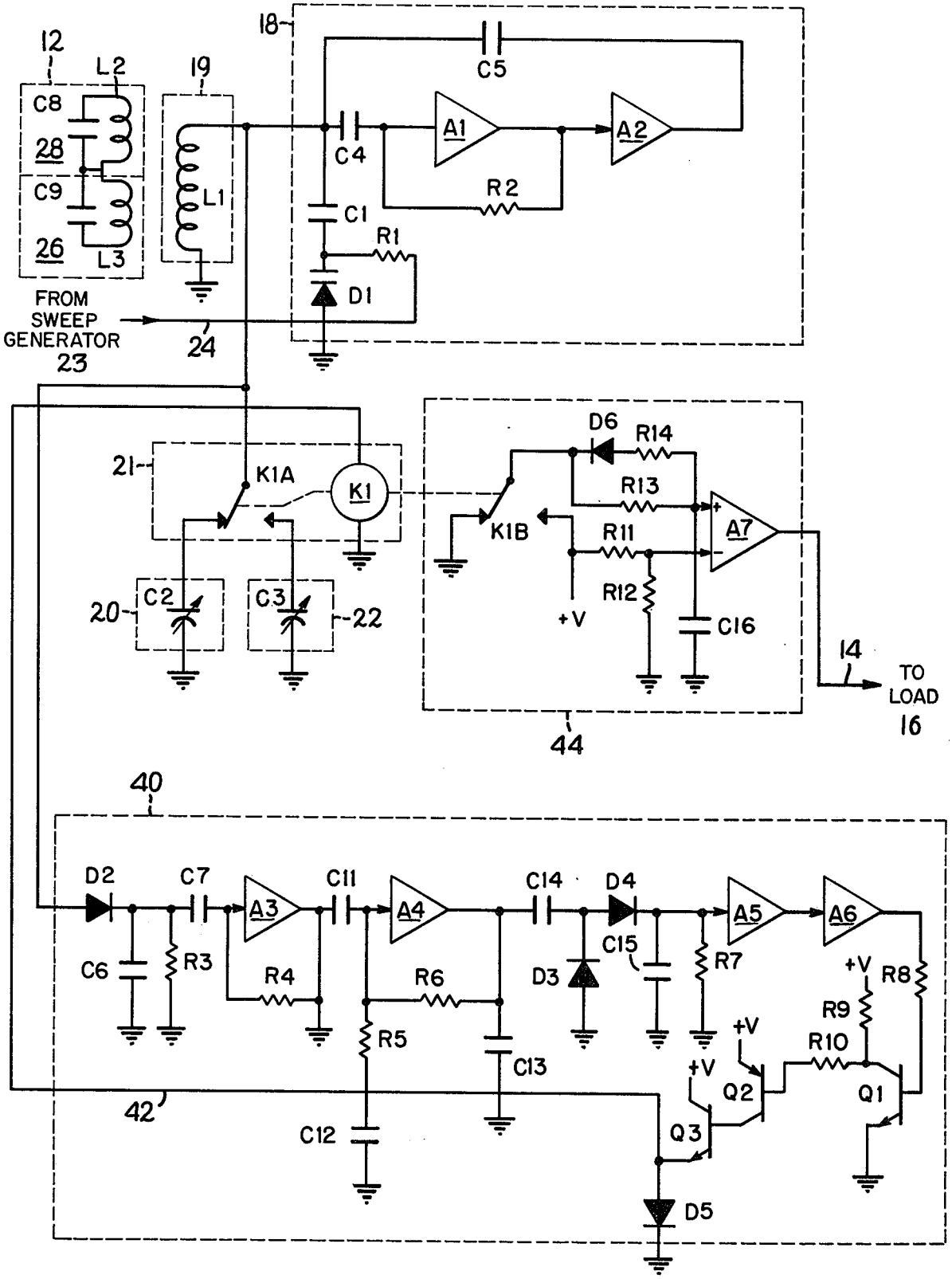
FIG. 3 is a detailed schematic diagram of portions of the system.

A representative set of values for the electrical components in FIG. 3 are contained in the following tabulation:

| Inductors (microhenrys) | | Resistors | | Capacitors | | Integrated Circuits | |
|---|---|---|---|---|---|---|---|
| L1 | 39 | R1 | 470K | C1 | 27pf | A1 | Ca 36006 |
| L2 | 39 | R2 | 1M | C2 | 147pf | A2 | Ca 36006 |
| L3 | 39 | R3 | 1M | C3 | 125pf | A3 | Ca 36006 |
| | | R4 | 1M | C4 | 5pf | A4 | Ca 36006 |
| | | R5 | 220K | C5 | 20pf | A5 | Ca 36006 |
| | | R6 | 1M | C6 | 500pf | A6 | Ca 36006 |
| | | R7 | 1M | C7 | .001 | A7 | Ca 36006 |
| | | R8 | 4.7K | C8 | 150pf | | |
| | | R9 | 4.7K | C9 | 200pf | | |
| | | R10 | 1K | C10 | .002 | | |
| | | R11 | 100K | C11 | .001 | | |
| | | R12 | 100K | C12 | .001 | | |
| | | R13 | 500K | C13 | .002 | | |
| | | R14 | 1K | C14 | .001 | | |
| | | | | C15 | .1 | | |
| | | | | C16 | 1 | | |

| Diodes | | Transistors | |
|---|---|---|---|
| D1 | MV1404 | Q1 | 2N3567 |
| D2 | IN5060 | Q2 | 2N4248 |
| D3 | IN5060 | Q3 | 2N3567 |
| D4 | IN5060 | | |
| D5 | IN5060 | | |

-continued

| Inductors (microhenrys) | | Resistors | Capacitors | Integrated Circuits |
|---|---|---|---|---|
| D6 | IN5060 | | | |

What is claimed is:

1. A keyable control circuit and keying circuit therefor comprising:

a. an rf oscillator operating at a first mean frequency;

b. means for cyclically varying the frequency of said rf oscillator about its mean frequency;

c. means for producing a first signal each time said oscillator is swept past some frequency within said cyclic frequency variation about said first mean frequency;

d. means for detecting said first signal;

e. means, operative in response to detection of said first signal, for shifting the mean frequency of said rf oscillator to a second mean frequency, the magnitude of said mean frequency shift being greater than twice the peak-to-peak amplitude of said cyclic variation imposed on said first and second mean frequencies;

f. means for producing a second signal each time said oscillator is swept past some frequency within said cyclic frequency variation about said second mean frequency;

g. means for detecting said second signal; and h. means operative in response to detection of said second signal to generate a control signal.

2. A keyable control circuit and keying circuit therefor as recited in claim 1 wherein said first signal producing means and said second signal producing means comprise:

a. an oscillator tank coil disposed in a location where inductive coupling thereto by external devices is possible; and b. a keying circuit containing two tuned circuits in a unitary portable container, said two tuned circuits being tuned to the radio frequency vicinity of said two mean rf frequencies.

3. A keyable control circuit and keying circuit therefor as recited in claim 1 wherein said keying circuit comprises:

a. a first inductor;

b. a first capacitor connected in parallel with said first inductor, the values of said first capacitor and inductor being such that the resonant frequency of the combination approximately matches said first mean rf frequency;

c. a second inductor connected in series with said first inductor; and d. a second capacitor connected in parallel with said second inductor, the values of said second capacitor and inductor being such that the resonant frequency of the combination approximately matches said second rf frequency.

4. A keyable control circuit as recited in claim 1 wherein said varying means comprises:

a. sweep generating means operative to generate a cyclically varying voltage;

b. a semiconductor diode whose junction capacitance provides at least part of the resonating capacitance of the tank circuit of said rf oscillator, said junction capacitance being variable with changes in diode bias; and c. means for applying said cyclically varying voltage across said diode whereby the diode junction capacitance is made to vary and said rf oscillator frequency is made to vary in step with said capacitance variation.

5. A keyable control circuit and keying circuit therefor as recited in claim 1 wherein said means for generating said first and second signals comprises:

a. a tank coil of said rf oscillator disposed in a location where inductive coupling thereto by external devices is possible;

b. a first tuned circuit in said keying circuit, the resonant frequency of said first tuned circuit being within the cyclic frequency variation about said first mean rf frequency;

c. means for inductive coupling between said first tuned circuit and said tank coil whereby said first tuned circuit is enabled to absorb rf energy from said tank coil when said rf frequency is swept past the resonant frequency of said first tuned circuit;

d. means for detecting the amplitude variations imposed on the first mean rf signal in said tank coil;

e. means for generating a first signal in response to said detected amplitude variation on said first mean rf signal;

f. means, operative in response to said first signal, to shift said mean rf frequency;

g. a second tuned circuit in said keying circuit, the resonant freeqency of said second tuned circuit within the cyclic frequency variation about said second mean rf frequency;

h. means for inductive coupling between said second tuned circuit and said tank coil whereby said second tuned circuit is enabled to absorb rf energy from said tank coil when said rf frequency is swept past the resonant frequency of said second tuned circuit;

i. means for detecting the amplitude variations imposed on the second mean rf signal in said tank coil;

j. means for generating a second signal in response to said detected amplitude variation on said second mean rf signal; and k. means for generating an output signal in response to said second signal.

6. A keyable control circuit and keying circuit therefor as recited in claim 1 wherein said means for shifting the mean frequency comprises:

a. a switch having first and second contacts, said first contacts normally being closed and said second contacts normally being open;

b. a connection from the tank circuit of said rf oscillator to the movable contact of said switch;

c. a first capacitance connected through the normally closed first contacts of said switch to said tank circuit whereby said first capacitance provides at least a part of the resonating capacitance of said rf oscillator;

d. a second capacitance connected to said normally open second contact of said switch, said second capacitance having a different value from said first capacitance; and e. means, operative in response to said first signal, for opening said first contacts and closing said second contacts of said switch whereby said first capacitance is disconnected from said oscillator tank and said second capacitance is substituted therefor.

7. A keyable control circuit and keying circuit therefor as recited in claim 1 wherein said means for detecting said first and second signals comprises:

a. a detector connected to the tank circuit of said rf oscillator operative to generate an ac-output when amplitude variations are present in the rf envelope of said rf oscillator; and b. peak detector mean operative in response to said ac signal to generate a constant dc signal as long as said ac signal persists.

8. A keyable control circuit and keying circuit therefor as recited in claim 1 wherein said control signal generating means comprises:

a. signal persistence means for maintaining said mean frequency shift for a predetermined time period after detection of said first signal;

b. a timer having a timing cycle longer than said persistence signal time period, operative to begin its timing cycle at the time said frequency shift occurs;

c. means, operative in response to detection of said second signal, to enable said timer to complete its timing cycle;

d. timer output means operative at the end of said time timing cycle to generate said control signal; and e. means for terminating said timer timing cycle without a control signal having been generated if detection of said second signal fails to occur before the end of said persistence time period.

9. A keyable control circuit and keying circuit therefor comprising:

a. at least one oscillator operating at a first mean frequency;

b. means for producing cyclical frequency variation in the frequency of said oscillator about said first mean frequency;

c. means for producing a first detection signal each time said oscillator is swept past some frequency within said cyclic frequency variation about said first mean frequency;

d. at least one means, operative in response to at least one previously produced detection signal, for shifting the mean frequency of said oscillator to at least a second mean frequency, said at least a second mean frequency being at least twice the magnitude of the peak-to-peak frequency variation away from each previously stated mean frequency;

e. means for producing at least a second detection signal each time said oscillator is swept past some frequency within said cyclic frequency variation about said at least a second mean frequency; and f. means, operative in response to a predetermined one of said at least a second detection signal, for generating a control signal.

* * * * *